US010849467B2

(12) United States Patent
Fletcher

(10) Patent No.: US 10,849,467 B2
(45) Date of Patent: Dec. 1, 2020

(54) CORNER MOULDING WITH BREAK-OFF BASE STEM PORTION

(71) Applicant: Donald J. Fletcher, Winnipeg (CA)

(72) Inventor: Donald J. Fletcher, Winnipeg (CA)

( * ) Notice: Subject to any disclaimer, the term of this patent is extended or adjusted under 35 U.S.C. 154(b) by 0 days.

(21) Appl. No.: 16/299,904

(22) Filed: Mar. 12, 2019

(65) Prior Publication Data

US 2019/0290075 A1 Sep. 26, 2019

(30) Foreign Application Priority Data

Mar. 16, 2018 (CA) ..... 2998243

(51) Int. Cl.
*A47K 3/00* (2006.01)
*E04F 19/02* (2006.01)

(52) U.S. Cl.
CPC ..... *A47K 3/008* (2013.01); *E04F 19/02* (2013.01)

(58) Field of Classification Search
CPC ..... E04F 19/045; E04F 19/02; E04F 19/0477; E04F 19/0486; A47K 9/008; E06B 1/62; E06B 2001/628; E06B 2003/6244; E06B 1/366; E04B 1/84
See application file for complete search history.

(56) References Cited

U.S. PATENT DOCUMENTS 2,303,864 A * 12/1942 Reasor ..... A47K 3/008 52/716.2
3,216,164 A * 11/1965 Stillman ..... E04F 19/045 277/637
4,289,818 A * 9/1981 Casamayor ..... A47K 3/001 4/614
4,601,149 A 7/1986 Dokan
4,760,681 A * 8/1988 Harrison ..... A47B 77/022 52/288.1
4,829,730 A * 5/1989 Zeilinger ..... A47K 3/001 52/287.1

(Continued)

FOREIGN PATENT DOCUMENTS

DE 10156045 A1 * 6/2003 ..... E04F 19/02
EP 2191755 A1 * 6/2010 ..... C09J 7/20

OTHER PUBLICATIONS

Machine translation of foreign reference DE 10156045, obtained from https://translationportal.epo.org/emtp/translate/?ACTION=description-retrieval&COUNTRY=DE&ENGINE=google&FORMAT=docdb&KIND=A1&LOCALE=en_EP&NUMBER=10156045&SRCLANG=de&TRGLANG=en (last accessed on Jul. 8, 2020) (Year: 2020).*

*Primary Examiner* — Theodore V Adamos
(74) *Attorney, Agent, or Firm* — Kyle R Satterthwaite; Ryan W Dupuis; Ade & Company Inc.

(57) ABSTRACT

A moulding usable in a corner joint between two structures features a base stem for adherence to the first structure using double-sided tape, and a cap attached to a proximal end of the base stem for placement against an outer surface of the second structure. The base stem features a break line at which a distal portion of the base stem can be cut, snapped or torn from a proximal portion of the base stem. If a sufficiently sized gap is present between the first and second structures, the base stem is left fully intact and inserted into the gap. In the absence of a sufficient gap, the distal portion of the base stem is detached at the break line, reducing to the base stem to a size that fits between the cap and the outer surface of the second structure.

11 Claims, 6 Drawing Sheets

(56) References Cited

U.S. PATENT DOCUMENTS

| | | | | |
|---|---|---|---|---|
| 5,010,703 | A * | 4/1991 | Pearlman | A47G 27/0456 52/273 |
| 5,553,431 | A * | 9/1996 | Pelosi, Jr. | E04F 19/045 52/272 |
| 6,802,161 | B1 | 10/2004 | Robinson | |
| 8,375,663 | B2 * | 2/2013 | Johnston | E04B 2/7422 52/287.1 |
| 9,115,532 | B1 * | 8/2015 | Sherman | E06B 1/34 |
| 9,797,131 | B1 * | 10/2017 | Battaglia | E04B 1/84 |
| 2003/0126825 | A1 * | 7/2003 | Dai | E06B 3/5814 52/717.01 |
| 2005/0177936 | A1 * | 8/2005 | Graells Pane | A47K 3/008 4/613 |
| 2014/0137496 | A1 * | 5/2014 | Fletcher | F16J 15/14 52/287.1 |

* cited by examiner

CORNER MOULDING WITH BREAK-OFF BASE STEM PORTION

CROSS-REFERENCE TO RELATED APPLICATIONS

This application claims benefit under 35 U.S.C. 119(a) of Canadian Patent Application No. 2,998,243, filed Mar. 16, 2018, the entirety of which is incorporated herein by reference.

FIELD OF THE INVENTION

The present invention relates generally to mouldings used in a corner joint between two structures, for example between the rim of a bathtub or shower tray and the surrounding walls upstanding therefrom.

BACKGROUND

Applicant's prior U.S. Pat. No. 8,997,414 and corresponding Canadian Patent No. 2,792,491 disclosed formation of a water tight seal in a corner joint between a bathtub rim or shower tray and the surrounding structural walls upstanding therefrom by installing an elongated corner moulding having a base stem with a cap at one end. An underside of the base stem is equipped with double-sided foam tape, and a bead of caulking is laid along an inner face of the cap behind an upper lip thereof that resides above the base stem. The distal end of the base stem furthest from the cap is inserted into a gap between the rim of the bathtub or shower tray and a lower edge of the finishing tiles on the tub/shower surround wall, bringing the caulked inner face of the cap into contact with the exposed outer surface of the wall tiles to create a water tight seal therewith, The moulding is pressed down against the rim of the tub or shower tray in order to adhere the underside of the base stem thereto via the double-sided tape.

An earlier corner moulding was disclosed in U.S. Pat. No. 4,760,681, where the moulding was instead fitted with double-sided tape on both the topside and underside of the base stem for sandwiched receipt of the base stem between a countertop and a backsplash during the installation of said backsplash. This earlier moulding design and installation technique was only useful during installation of a new backsplash and could not be applied to an existing backsplash on a retrofit basis.

Applicant's previously patented moulding on the other hand could be installed on a retrofit basis in wall tile applications, where properly installed tile would not reach fully down to the tub or shower tray, and instead would terminate a short distance above the rim of the tub or shower tray to leave a gap space therebeween. Prior to Applicant's previously patented invention, this gap was conventionally covered only by caulking to create a flexible, water-proof seal. A user, whether a trained installer or do-it-yourself (DIY) homeowner, could therefore typically perform a retrofit installation of Applicant's previously patented moulding quickly and easily by removing the old caulking to re-open the gap between the tile and the tub or shower tray, and thereby by enable insertion of the moulding's base stem.

However, in the event that the tile was installed improperly and rested directly atop the tub or shower tray, leaving no gap for insertion of the moulding's base stem, or in the event that a gap was present but not large enough to accommodate insertion of the base stem, installation of the moulding could not be performed, at least without having to trim the bottom edges of the installed tiles to create or enlarge the gap, adding complexity, mess and additional tool requirements to the job, to the point that it may become too involved for a DIY installer.

Accordingly, it would be desirable to provide a solution enabling installation of the corner moulding regardless of the presence or absence of a sufficiently sized gap for the moulding's base stem. It would also be desirable to provide an alternative to the use of caulking during installation of Applicant's previously patented moulding for a cleaner, more convenient installation, particularly for DIY users.

SUMMARY OF THE INVENTION

According to one aspect of the invention, there is provided a moulding for use at a corner joint between a first structure having an exposed surface lying in a first plane and a second structure having an outer surface lying in a second plane that intersects said first plane, said moulding comprising:

an elongated body having a longitudinal dimension for extending along the corner joint and a cross-sectional shape that is defined in planes perpendicular to said longitudinal dimension and that comprises a base stem for optional insertion into a gap between the first and second structures, if present, and a cap integrally attached to a proximal end of the base stem to lie outside said gap, if present, the cap defining an upper lip for contact against the outer surface of the second structure at a spaced distance from a topside of the base stem and an underside of the base stem being adherable to the exposed surface of the first structure; and a break line running longitudinally of the base stem to denote a boundary between a proximal portion of the base stem situated adjacent the cap, and a distal portion of the base stem that reaches further from the cap and is selectively detachable from the proximal area by cutting or snapping of the distal portion from the proximal portion along said break line.

Preferably, a reference plane lies perpendicularly to the base stem of the body and intersects an upper tip of the upper lip of the cap of the body, and a distance from the proximal end of the base stem to the break line is no greater than a distance from the proximal end of the base stem to the reference plane, whereby in the presence of said gap between the first and second structures the distal area of the base stem is insertable into said gap, and in the absence of said gap, the distal portion of the base stem is detachable from the proximal portion along the break line to reduce the base stem to a smaller size capable of fitting between the cap and the outer surface of the inner structure when the upper lip is placed thereagainst.

Preferably there is double-sided tape extending the longitudinal dimension of the body with an upper surface of the tape adhered to an underside of the base stem for adhesion of the underside of the base stem to the exposed surface of the first structure, and the double-sided tape may occupy both the proximal and distal portions of the base stem, in which case the break line may denote a cutting guide for trimming the double-sided tape down to the proximal portion of the base stem after detachment of the distal portion thereof.

In one embodiment, there is provided an additional length of double-sided tape extending the longitudinal dimension of the body and attached to an inner face of the upper lip below the upper tip thereof for adhesion of said upper lip of the cap to the outer surface of the second structure via said length of double-sided tape.

The break line may comprise a weakened break line of reduced thickness relative to a remainder of the base stem. The thickness of the weakened break line may be sufficiently reduced to enable snapped or torn removal of the distal portion of the base stem along the break line.

According to a second aspect of the invention, there is provided a method of installing moulding at a corner joint between a first structure having an exposed surface lying in a first plane and a second structure having an outer surface lying in a second plane that intersects said first plane, said method comprising:

obtaining a moulding comprising an elongated body having a longitudinal dimension for extending along the corner joint and a cross-sectional shape that is defined in planes perpendicular to said longitudinal dimension and that comprises a base stem for optional insertion into a gap between the first and second structures, if present, and a cap integrally attached to an end of the base stem to lie outside said gap, if present, the cap defining an upper lip for contact against the outer surface of the second structure at a spaced distance from a topside of the base stem and an underside of the base stem being adherable to the exposed surface of the first structure;

making an assessment of whether there is a sufficiently sized gap between the exposed surface of the first structure and the said outer surface of the second structure to accommodate insertion of the base stem into said sufficiently sized gap; and based on an outcome of said assessment, either:

(a) in the presence of said sufficiently sized gap, inserting the base stem into the sufficiently sized gap, and placing the upper lip of the cap against the outer surface of the second structure and the underside of the base stem into adhesive attachment to the exposed surface of the first structure; or (b) in the absence of said sufficiently sized gap, detaching a distal portion of the base stem from a proximal portion thereof that joins with the cap, thereby shortening a distance by which said base stem projects from the cap, and placing the upper lip of the cap against the outer surface of the second structure and the underside of the remaining proximal portion of the base stem into adhesive attachment to the exposed surface of the first structure.

Step (b) may comprise snapping the distal portion of the base stem from the proximal portion thereof.

Alternatively, step (b) may comprise tearing the distal portion of the base stem from the proximal portion thereof.

Alternatively, step (b) may comprise cutting the distal portion of the base stem from the proximal portion thereof.

The moulding may have pre-attached double-sided tape adhered to an underside of the base stem at both the proximal and distal portions thereof, in which case step (b) preferably comprises first detaching the distal portion of the base stem from the proximal portion thereof, and then trimming the double-sided tape down to the remaining proximal portion of the base stem by cutting the double-sided tape along the break line.

The method may comprise adhesively attaching the upper lip of the cap to the outer surface of the second structure using double-sided tape adhered to an inner face of the upper lip of the cap below an upper tip thereof.

According to a third aspect of the invention, there is provided a moulding for use at a corner joint between a first structure having an exposed surface lying in a first plane and a second structure having an outer surface lying in a second plane that intersects said first plane, said moulding comprising:

an elongated body having a longitudinal dimension for extending along the corner joint and a cross-sectional shape that is defined in planes perpendicular to said longitudinal dimension and that comprises a base stem and a cap integrally attached to an end of the base stem, the cap defining an upper lip for contact against the outer surface of the second structure at a spaced distance from a topside of the base stem and an underside of the base stem being adherable to the exposed surface of the first structure;

a first length of double-sided tape extending the longitudinal dimension of the body with an upper surface of the tape adhered to the underside of the base stem for adhesion of the underside of the base stem to the exposed surface of the first structure by said first length of double-sided tape; and a second length of double-sided tape extending the longitudinal dimension of the body and adhesively attached to an inner face of the upper lip below an upper tip thereof for adhesion of said upper lip of the cap to the outer surface of the second structure by said second length of double-sided tape.

Preferably the double-sided tape is double-sided foam tape.

Preferably the double-sided tape is pressure sensitive.

Preferably the double-sided tape is acrylic foam tape.

In some embodiments, a topside of the base stem is free of any double-sided tape.

BRIEF DESCRIPTION OF THE DRAWINGS

One embodiment of the invention will now be described in conjunction with the accompanying drawings in which.

DETAILED DESCRIPTION

Figure 1:
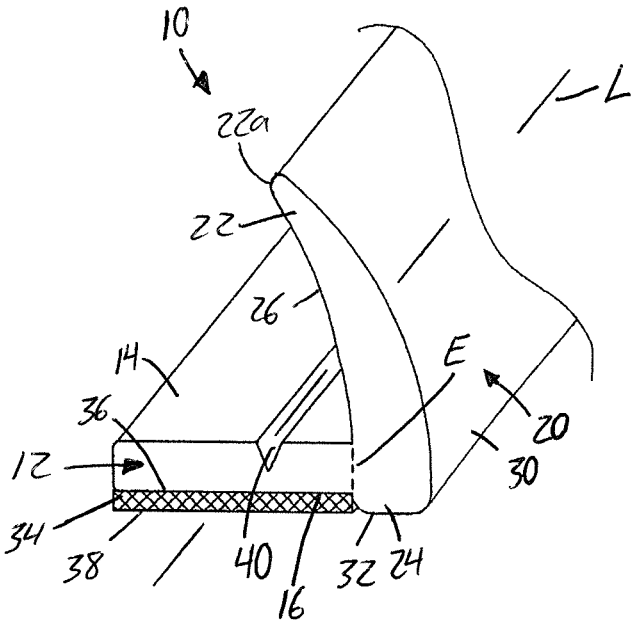
FIG. 1 is a partial perspective end view of a corner moulding according to the present invention.

FIG. 1 shows a moulding 10 formed by extrusion of polyvinyl chloride (PVC), and having general similarity in shape to the PVC moulding shown in Applicant's aforementioned U.S. Pat. No. 8,997,414, the entirety of which is incorporated herein by reference.

The cross-sectional shape of the moulding in planes normal to its longitudinal axis L features a rectangular base stem 12 having a topside 14, an opposing underside 16, and a free distal or inner end 18. Integrally attached to the opposing proximal or outer end of the rectangular base stem 12 is a cap 20 having a larger upper lip 22 that projects a notable distance upward from the topside of the base stem 12, and a smaller lower lip 24 that juts a shorter distance downward from the underside of the base stem 12. The proximal end of the base stem is denoted in the drawings by broken line E. The moulding of the illustrated embodiment features a unitary body that defines the rectangular base stem 12 and the cap 20 as seamlessly integral parts of a unitary whole. The illustrated embodiment of the moulding 10 features a uniform material composition throughout, but co-extruded embodiments employing material variations in different layers or portions are also contemplated within the scope of the present invention.

Figure 10:
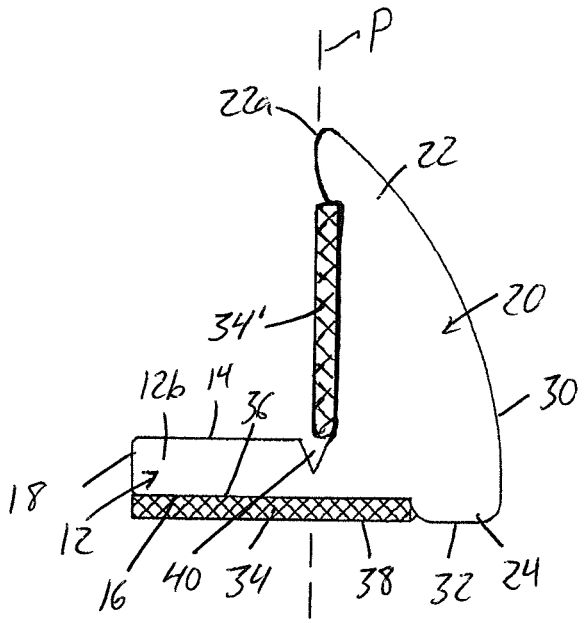
FIG. 10 illustrates an alternative embodiment of the corner moulding, in which the bead of caulking is replaced with a second piece of double-sided tape.
Figure 11:
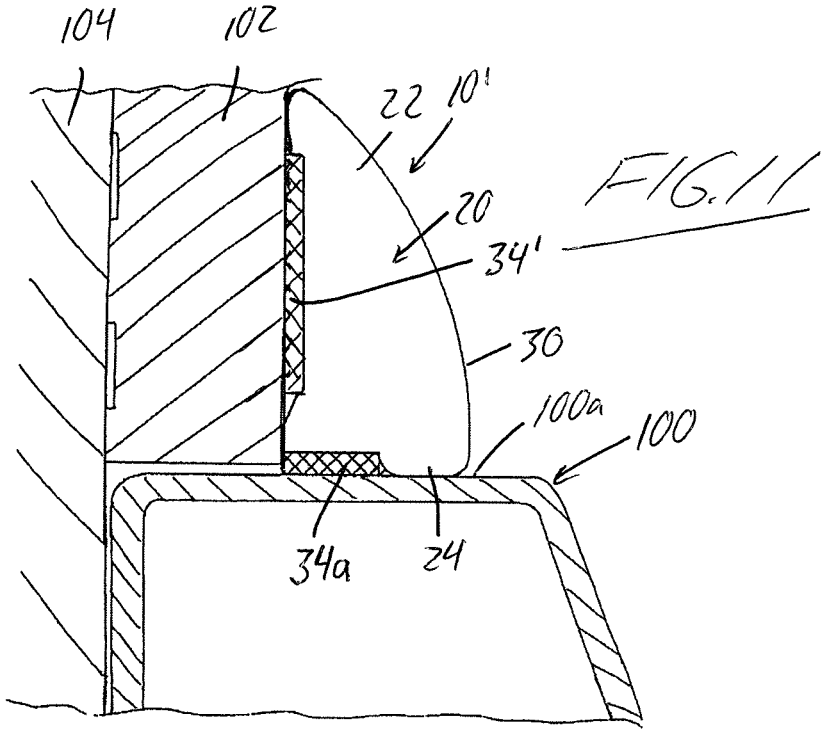
FIG. 11 shows the fully installed state of the FIG. 10 moulding in a corner joint of the second type shown in FIG. 5.

An inner face 26 of the upper lip 22 faces back over the base stem 12 and rises therefrom at a slightly acute angle A, for example approximately 87-degrees, with the flat topside of the base stem 12. An inner face 28 of the lower lip 24 initially forms a right angle with the flat underside of the base stem 12, then transitions into a flat underside 32 of the lower lip 24 through a curved corner. An outer face 30 of the cap 20 convexly joins a top end of the inner face 26 of the upper lip 22 to the underside 32 of the lower lip 24, giving the cap a fin-like shape that widens from a point-like upper tip 22*a* at the top of the upper lip 22 down to the wider lower lip 24. In the illustrated embodiment, the inner face of the upper lip is concave in curvature between the upper tip 22*a* and the base stem 12, and so its angle of incline grows less steep from initial angle A moving upward toward the tip 22*a*. The radius of curvature at the inner face 26 is less than the radius of curvature at the outer face 30, thus resulting in the downwardly widening shape of the upper lip in its thickness dimension measured between its inner and outer faces. In other embodiments, the upper lip may have a more uniform thickness where the curvature at the inner and outer faces are of matching profile. Other profiles of the other lip may alternatively be used, and the inner and outer faces need not necessarily have smoothly curved profiles like those of the present embodiment. For example, an alternate inner face profile is shown in the embodiment of FIGS. 10-11, and described herein further below.

Double-sided foam tape 34 features adhesive at both its upper and lower surfaces 36, 38, and the upper surface 36 of the tape 34 is adhered to the underside 16 of the base stem 12 of the moulding 10 over the full length thereof. The width of the tape 34 spans an entirety, or at least a majority, of the base stem's width, which is measured from the free distal end thereof to where the lower lip 24 of the cap juts downwardly from the base stem 12 at the proximal end E thereof. The topside 14 of the base stem 12 is free of any such tape or other adhesive in the illustrated embodiment, though other embodiments may feature the tape or other adhesive, optionally of the same type, on the topside of the base stem. The adhesive lower surface 36 of the tape 34 is preferably initially concealed and protected by a suitable strip of covering material (not shown), which is subsequently removed before or during installation of the moulding.

Suitable tapes include commercially available tape products from the RP series of VHB tapes marketed by the 3M Company of St. Paul Minn., with one particular example being VHB™ RP45(F) tape. The selected tape is a double-sided, pressure sensitive, acrylic foam tape with a 0.045-inch thickness and a film-liner, although VHB tapes of other thicknesses and liner materials would likewise be suitable for use within the context of the present invention, as would tapes of comparable properties and performance, whether from 3M or other manufacturers. VHB tapes are marketed as being suitable for waterproofing applications, providing a permanent bond for sealing against water and other environmental elements, thus being particularly useful in the illustrated context of installing the moulding as part of a waterproof sealing solution between a bathtub or shower tray and upright walls surrounding same.

The base stem includes a weakened break line 40 that resides at an intermediate location between the proximal and distal ends of the base stem 12, and runs the full longitudinal dimension of the moulding 10 from one end thereof to the other. In the illustrated example, the break line 40 is defined by a V-shaped groove in the otherwise flat topside 14 of the base stem 23, thus providing a localized area of reduced stem thickness at a location situated part way between the proximal and distal ends of the base stem. Here, the thickness of the base stem measured from the underside 16 thereof to the lowermost point of the V-shaped groove is notably less than the uniform thickness measured elsewhere on the base stem between the underside of the base stem and the flat majority of the stem's topside on opposite sides of the break line 40. The part of the base stem located between the break line 40 and the cap 20 is referred to herein as the proximal portion 12*a* of the base stem, while the part of the base stem reaching to the distal end thereof on the opposing side of the break line is referred to herein as the distal portion 12*b* of the base stem 12.

The grooved break line 40 of the illustrated embodiment serves to provide both a visual guide along which the base stem can be optionally cut in the longitudinal direction to sever the distal portion of the base stem from the proximal portion thereof, and also a sufficiently weakened snap or tear line along which the distal portion 12*b* of the base stem can be snapped or torn off by applying sufficient leverage to the distal end of the base stem, whether manually or with the aid of pliers or other assistive tool. In other embodiments, the break line 40 may be a purely visual cutting guide lacking any recessed groove or indentation in the surface of the base stem, but the illustrated use of a recessed groove is preferable, as this provides both a tactile cutting path for knife or saw blade to follow in the case of cut detachment, and preferably a sufficiently reduced thickness or brittleness to enable snapped or torn detachment so that use of potentially hazardous cutting tools can be avoided.

In the illustrated embodiment, the double-sided tape 34 on the underside of the base stem is pre-attached to the moulding 10 prior to distribution to the installer, and so the break line 40 is placed at the uncovered topside of the base stem 12 so as to be readily visible to the installer. In other embodiments, the break line 40 may alternatively reside at an initially uncovered underside of the base stem, to which double-sided tape is subsequently adhered by the installer, after optionally detaching the distal portion 12*b* of the base stem 12 if required, as explained in more detail further below.

Figure 1A:
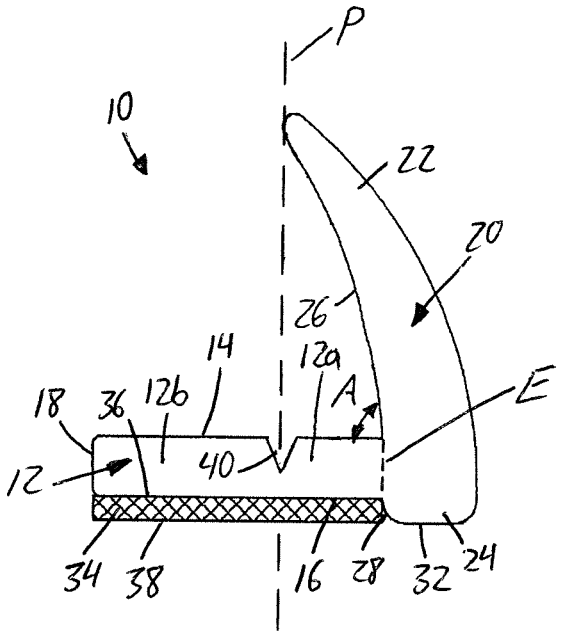
FIG. 1A is an end elevational view of the corner moulding of FIG. 1.

As shown in FIG. 1A, reference plane P perpendicularly intersects the base stem 12 and contains the upper tip 22*a* of the cap's upper lip. The reference plane in the illustrated example intersects the base stem at the break line 40 so as to bisect the V-shaped groove in the topside 14 of the base stem 12, and thereby designates an imaginary boundary between the proximal and distal portions 12*a*, 12*b* of the base stem 12. The break line 40 is thus centered on the reference plane P, whereby once the distal portion 12*b* of the base stem 12 is snapped or cut from the proximal portion 12*a* along the break line 40, the remaining proximal portion 12*a* of the base stem 12 will terminate at the reference plane P. The reduce-width base stem defined by this remaining proximal portion 12*a* of the original full-width base stem after breaking off the distal portion 12*b* therefore does not project beyond the reference plane P. While the upper tip 22*a* of the cap's upper lip 22 resides in the reference plane P, the entire remainder of the cap 20 resides entirety on the same proximal side of the reference plane P as the proximal portion 12*a* of the base stem 12. Accordingly, like the reduced base stem, no part of the cap 20 reaches past the reference plane P to the distal side thereof. The reference plane thus designates the plane of contact between the upper lip of the moulding cap and an outer surface of the wall structure against which the upper lip of the cap is placed during installation of the moulding, as described in more detail below.

Figure 2:
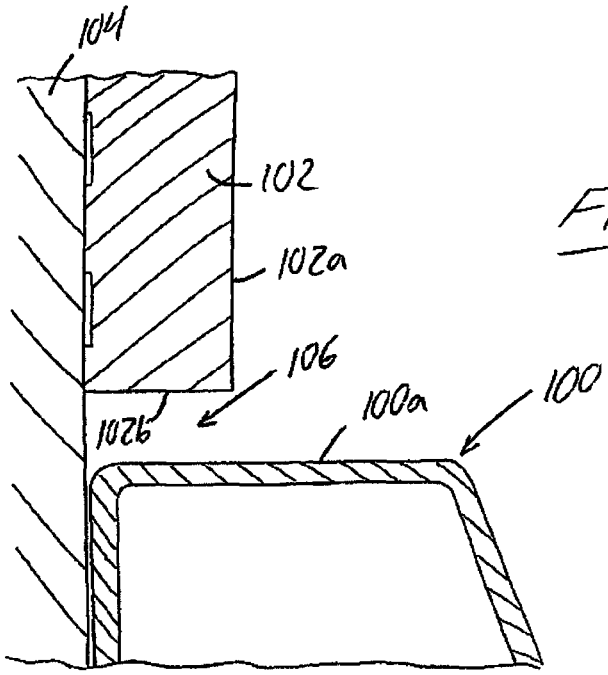
FIG. 2 is a cross-sectional view of a first type of corner joint in which the corner molding of FIG. 1 can be installed at a gap between the rim of a bathtub and a tiled surround wall upstanding therefrom.
Figure 5:
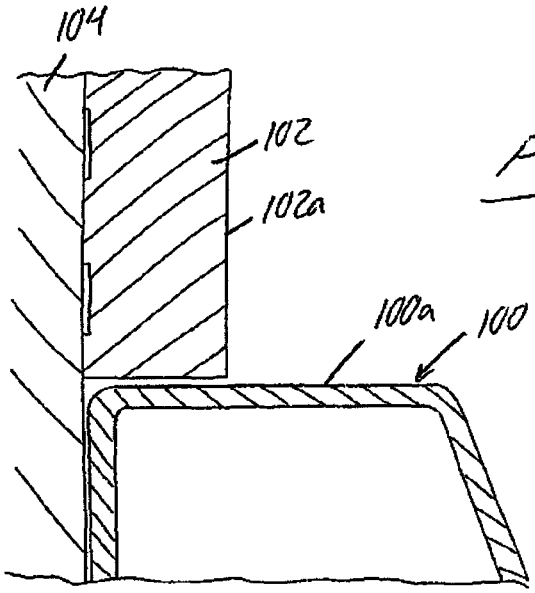
FIG. 5 is a cross-sectional view of a second type of corner joint between the rim of a bathtub and a tiled surround wall upstanding therefrom, where the gap between the bathtub and the wall tile is insufficient to accommodate the base stem of the corner moulding.

FIG. 2 illustrates one context in which the moulding 10 of the present invention may be installed in the same manner described in Applicant's aforementioned prior patents, while FIG. 5 illustrates another context for which Applicant's previously patented design was not well suited, unlike the uniquely configured moulding of the present invention with its strategically placed break line.

In both of these illustrated contexts, the moulding 10 is used at a horizontal corner joint formed between the generally horizontal upper surface of a bathtub rim 100 extending around the perimeter of the tub interior at the top of the tub walls, and the generally vertical outer surface of a layer of wall tiles 102 installed on an upright wall 104 against which the tub has been installed. The rim of the tub thus designates a generally horizontal first structure with an exposed upper surface 100*a* jutting out from the wall structure in a first generally horizontal plane, while the wall structure denotes a generally vertical second structure on which the wall tiles 102 define an outer surface 102*a* residing in a generally vertical plane that intersects the generally horizontal plane of the tub's exposed rim surface 100*a*.

The context in FIG. 2 includes a pre-existing gap 106 that is found between the bottom edge 102*b* of the lowermost row of tiles 102 and the exposed upper surface 100*a* of the tub rim 100, thus designating a gap between the exposed surface of the first structure and a tiled or other external finishing layer of the second structure. This gap 106 in FIG. 2 is tall enough to accommodate insertion of the base stem 12 of the moulding 10, while the context in FIG. 5 lacks a sufficiently sized gap capable of admitting the base stem 12 of the moulding 10 between the tiled finishing layer of the wall structure and the exposed upper surface 100*a* of the tub rim 100.

Figure 3:
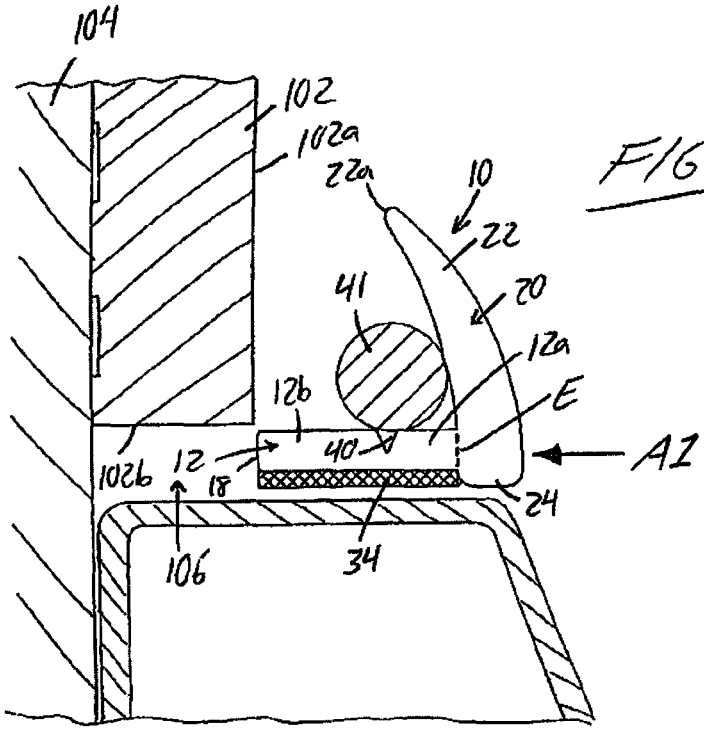
FIG. 3 a cross-sectional view of the corner moulding of FIG. 1 with a bead of caulking applied thereto prior to installation at the corner joint of FIG. 2.
Figure 4:
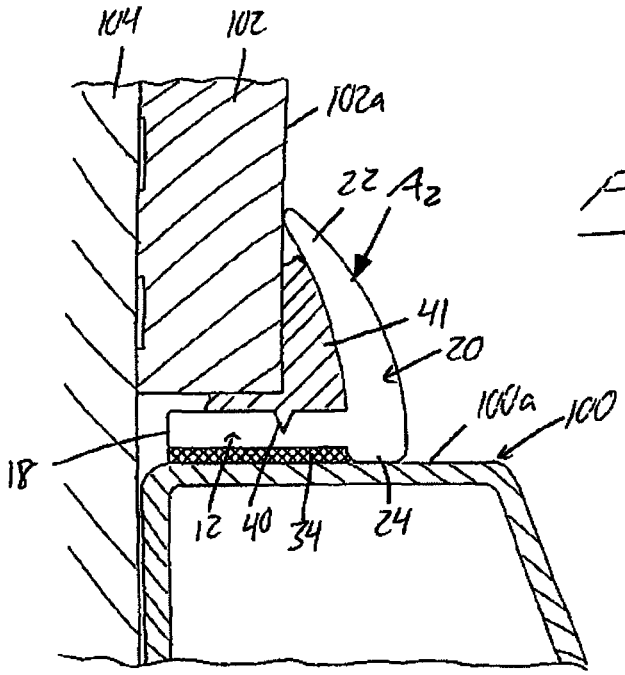
FIG. 4 is a cross-sectional view of the corner moulding and caulking of FIG. 3 once fully installed in the corner joint so that a base stem of the moulding reaches into the gap between the bathtub and wall tile.

Installation of the moulding 10 in the first context is illustrated in FIGS. 3 and 4, and closely follows that described in Applicant's aforementioned prior patents. Turning to FIG. 3, to prepare the moulding for installation, a bead of silicone or other caulking material 41 is first applied along the length of the moulding 10 at the inner face 26 of the upper lip 20 of the moulding 10, for example at the acute-angle corner defined between this face 26 and the top surface 14 of the base stem 12 of the moulding 10. Before or immediately after the application of the caulking 41 to the moulding 10, at least and end portion of the protective cover strip (not shown) is removed from the foam tape 34 to exposed at least some of the adhesive bottom surface 38 thereof. As shown in FIG. 3, the gap 106 between the tub surface and bottom tile edge has a height slightly exceeding the height or thickness of the base stem 12 of the moulding 10. The base stem 12 of the moulding 10, and the foam tape 34 attached to the underside thereof, is inserted into the gap 106, as shown by arrow A1, with the topside of the base stem 12 closely adjacent the bottom edge 102*b* of the tiles 102 so as to keep the exposed adhesive at the bottom surface 38 of the foam tape 34 distanced from the tub surface during this insertion. Pressure sensitive adhesive is preferably used so that inadvertent low-pressure contact of the foam tape 34 against the tub surface 100*a* during the insertion process will not form an excessive bond to the tub surface, and will allow separation of the moulding therefrom to allow lifting and continued insertion of the moulding, or removal and reinsertion thereof, to ensure sufficient insertion of the moulding into the gap before adhesion of the moulding to the tub.

The base stem 12 of the moulding is inserted into the gap 106 until the upper tip 22*a* of the upper lip 22 is abutted against the outer surface 102*a* of the tile layer 102 of the wall. At this point, the moulding 10 is then pressed downward, as shown at arrow A2 of FIG. 4, to force the adhesive at the bottom surface 38 of the foam tape 34 against the horizontal tub surface 100*a*. This insertion and downward pressing of the moulding is repeated along the length of the moulding, during which more of the double-sided tape's covering layer is peeled off at each insertion step if the tape was not fully uncovered beforehand.

As shown in the fully installed position in FIG. 4, the moulding 10 is thus held in place with the upper tip 22*a* of the upper lip 22 in tight contact against the tile surface 102*a*. The adherence of the underside 16 of the base stem 12 of the moulding to the tub surface 100*a* by the foam tape 34 holds the underside 32 of the lower lip 24 of the moulding 10 in contact against the tub surface 100*a* outside the gap at a location fully outside the wall structure. A water tight seal between the upper lip 22 of the moulding 10 and the wall tile 102 is accomplished by the silicone caulking 41 now sandwiched between the moulding and the tile. The caulking ensures a proper water-tight seal between the moulding 10 and the slight recessing of the surface tile layer 102*a* of the wall at the vertical grout lines between the tiles 102, as the forcing of the upper lip 22 of the moulding against the tiles 102 during installation squeezes the caulking 41 into any available space between the grout lines and the inner face 26 of the moulding's upper lip 22.

Accordingly, although the point-like upper tip 22*a* at the top of the upper lip may be thin enough in some embodiments to have sufficient flexibility to conform completely against a recessed grout line, even if a complete water-tight seal of the upper lip of the moulding against the wall structure is not achieved at the grout lines, the caulking 41 sandwiched between the moulding cap 20 and the tiled finishing layer of the wall structure seals the wall and the moulding together over the full length thereof.

The foam tape adhesive provides a strong enough bond to the tub surface 100*a* to hold the moulding in contact against the tub and tile, while the caulking provides a flexible water tight seal between the moulding and the tile. This way, some relative movement between the tub and the wall, as may occur when the tub is subjected to the weight of occupants, is accommodated by the flexibility of the caulking without detriment to the water tightness of the seals.

Figure 6:
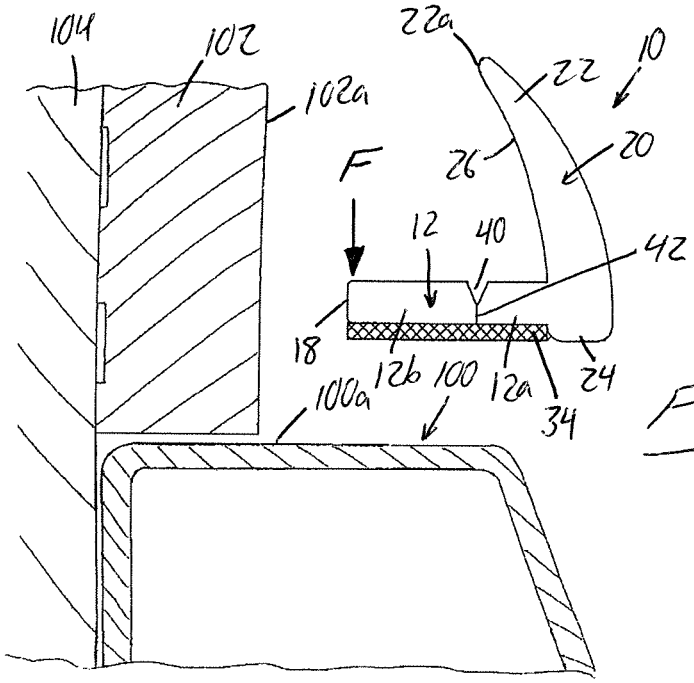
FIG. 6 illustrates a first step of installing the corner moulding of FIG. 1 at the corner joint of FIG. 5, during which part of the base stem of the moulding is broken of from an intact remainder thereof.

Turning to FIG. 5, in the context where there's insufficient gap space between the wall tiles and tub surface for insertion of the moulding's base stem, a novel installation technique is instead employed. With reference to FIG. 6, first the distal portion 12*b* of the base stem 12 is separated from the proximal portion 12*a* thereof, for example snapping or tearing the distal portion 12*b* off by applying a downwardly leverage force F to the distal portion of the base stem near the distal end 18 thereof, thereby creating a break 42 in the thinned area of the base stem 12 beneath V-shaped groove of the break line 40. Rather than creating a full break, the initial leveraging of the distal portion may bend or fold and thereby further weaken the thinned area, along which the distal portion can then be torn off by pulling the distal portion in a shearing direction from one end of the moulding to the other.

Figure 7:
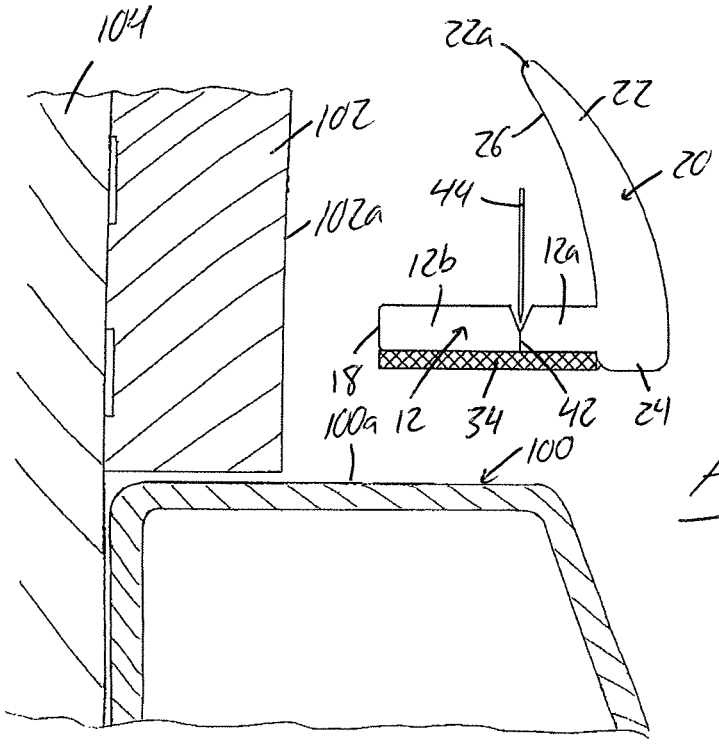
FIG. 7 illustrates a second step of installing the corner moulding of FIG. 1 at the corner joint of FIG. 5, during which double-sided tape on the underside of the base stem is trimmed along the break line between the broken off and intact portions of the moulding's base stem.

Turning to FIG. 7, in embodiments where the double-sided tape 34 is pre-applied to the underside of the base stem, the blade 44 of a utility knife or other cutting tool is through the V-shaped groove of the break line 40 and the underlying break 42 in the base stem into engagement with the double-sided tape 34, and then pulled along the break line 40 in order to trim the tape 34 flush with the intact proximal portion 12*a* of the base stem 12. This trims off the distal part of the tape that underlies the broken-off distal portion 12*b* of the base stem 12, thus enabling the distal portion 12*b* of the base stem 12 and the attached distal part of the tape 34 to be fully removed from the intact proximal portion 12*a* of the base stem and the remaining proximal part of the tape that remains therebeneath.

Figure 8:
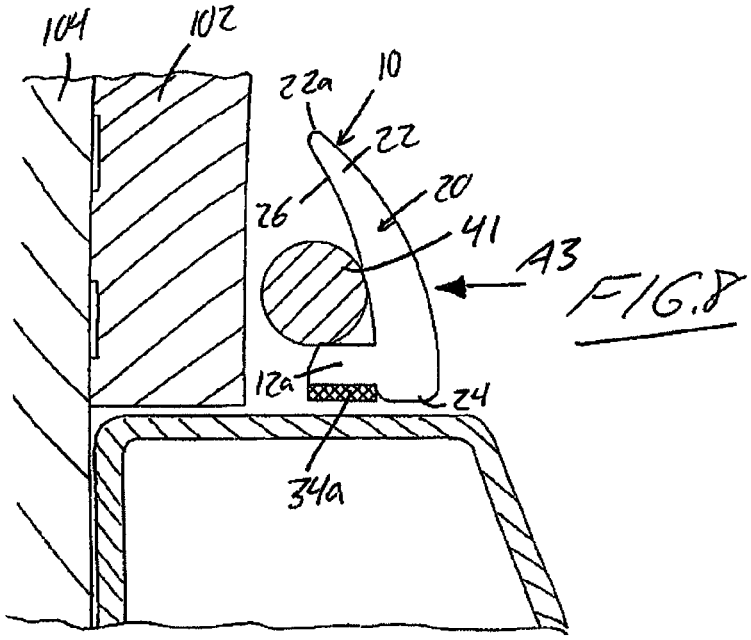
FIG. 8 illustrates a third step of installing the corner moulding of FIG. 1 at the corner joint of FIG. 5, during which bead of caulking is applied to the moulding, which is then pressed into contact with the bathtub and wall tile at the corner joint therebetween.

Turning to FIG. 8, the removal of the distal base stem portion 12*b* and distal tape part leaves the moulding 10 in a reduced state of lesser width in which the remaining proximal portion 12*a* of the base stem 12 and underlying proximal part 34*a* of the double-sided tape don't project beyond the reference plane P that intersects the upper tip of the cap's upper lip. A bead of silicone 40 or other caulking material is then applied along the length of the moulding 10 at the inner face 26 of the upper lip 20, for example at the acute-angle corner defined between this face 26 and the top surface 14 of the remaining proximal portion 12*a* of the base stem 12. Before after the application of the caulking to the moulding 10, the protective cover strip (not shown) is at least partially removed from the bottom surface 38 of the remaining proximal part 34*a* of the foam tape 34.

Figure 9:
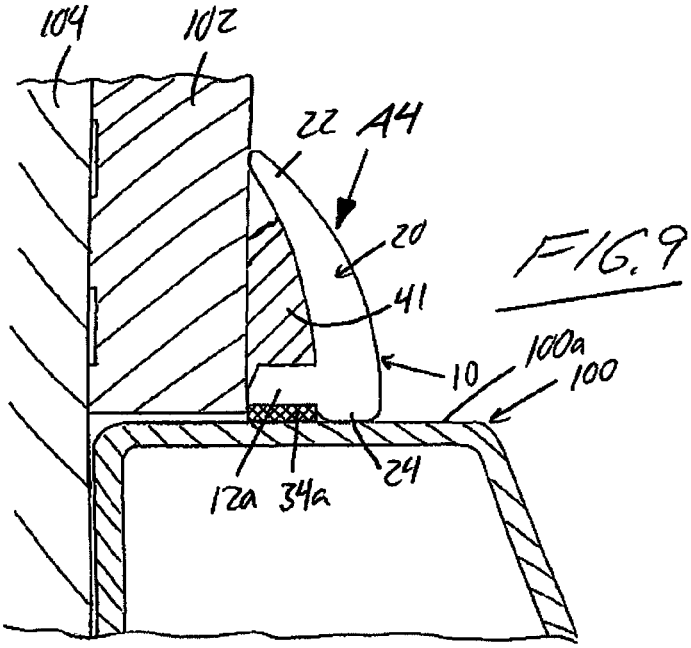
FIG. 9 illustrates the corner moulding and caulking of FIG. 8 once fully installed in the corner joint.

With the intact proximal portion 12*a* of the base stem 12 held in close but non-contacting elevation to the tub surface 100*a*, the reduced moulding is pushed toward the corner between the exposed upper tub surface 100*a* and the outer tile surface 102*a*, as shown by the solid head arrow A3 in FIG. 8, until the upper lip 22 of the cap 20 and the broken end of the remaining proximal portion 12*a* of the base stem 12 are abutted against the outer surface 102*a* of the tile layer 102 of the wall. At this point, as shown by the solid head arrow A4 in FIG. 9, the moulding 10 is then pressed downward to force the adhesive at the bottom surface 38 of the remaining proximal part 34*a* of the foam tape 34 against the exposed tub surface 100. In this fully installed position, the moulding 10 is thus held in place with the upper tip 22*a* of the upper lip 22 in tight contact against the outer tile surface 102*a*, while the underside of the proximal portion 12*a* of the base stem 12 is held in adhesive attachment the exposed upper tub surface 100*a* by the foam tape, and the underside 32 of the lower lip 24 of the moulding is thereby held in contact against the exposed upper tub surface 100*a*. Meanwhile, a water tight seal between the upper lip 22 of the moulding and the wall tile 102 is accomplished by the silicone caulking 41 now sandwiched between the moulding and the tile.

So in the first context of FIGS. 2-4, the full-width base stem 12 protrudes partially into the wall structure beneath the tiled finishing layer thereof via an available gap space 106 beneath this finishing layer, thus allowing for optimal adhesion to the tub surface 100*a* by using full-width tape on the underside of the full-width base stem to maximize the area of adhesion. On the other hand, should an installer of the moulding find that a sufficient gap space is not available to accommodate the base stem of the moulding after having already purchased the moulding, he or she can simply trim the moulding down to its reduced state by cutting or snapping the base stem along the break line 40, and then install the reduced molding in a position where it resides externally of the wall structure entirety outside the tiled finishing layer thereof. Production of one moulding that can be used in both contexts is convenient from a manufacturing perspective, retail perspective, and consumer perspective. The purchaser/installer need not know the type of installation context ahead of time, and the retailer need not worry that the purchaser will return a full-stem moulding product due to incompatibility with a gapless installation context.

While the forgoing embodiment features pre-applied full-width tape 34 on the underside of the base stem, which requires trimming in the instance of a gapless installation context, another embodiment may alternatively employ to narrower strips of partial-width tape, one adhered solely to the underside of the base stem's distal portion, and another adhered solely to the underside of the base stem's proximal portion. In such instance, no trimming of the tape is required after cutting or snapping off the distal portion of the base stem. Alternatively, in a two-strip tape configuration, only the proximal strip of tape underlying the proximal portion of the base stem may be pre-attached to the moulding, and a separate distal strip of tape is attached to the underside of the distal portion of the base stem by the installer only if the moulding is being installed in a fully intact full-width state in a sufficiently gapped corner joint. However, applicant has found that a single length of wider tape is more cost efficient than two separate lengths of narrower tape, and so use of full-width tape that is trimmed by the installer for gapless installation contexts may be preferable from an economic point of view.

FIGS. 10 and 11 illustrate another embodiment of the moulding 10', which in addition to the first length of double sided foam tape 34 running the length of the moulding on the underside of the base stem 12, features a second length of double-sided foam tape 34' running the length of the moulding on the inner face 26 of the cap's upper lip 22. In this embodiment, the second length of double-sided tape 34' is used instead of the bead of caulking 41 to form a water-tight seal between the inner face 26 of the cap's upper lip 22 and the outer surface 102*a* of the tiled finishing layer 102 of the wall. In the illustrated example, the inner face 26 of the cap's upper lip has a flat area that lies perpendicularly to the base stem 12 at a short offset distance from the reference plane P on the proximal side thereof. The second length of double-sided tape 34' is laid on this flat area of the upper lip's inner face and has sufficient thickness to reach into the reference plane P, while the upper tip 22*a* of the cap's upper lip 22 spans over the top edge of the tape 34' to reach the same reference plane P and thus conceal the tape 34' from sight in the installed position of the moulding, as shown in FIG. 11.

Alternatively, the upper lip of the second embodiment moulding 10' may have a more curved or angled inner face like that of the first embodiment if the material composition or thin shape of the cap 20 provides the upper lip 22 with enough flexibility that its inner face 26 can be pushed generally flat against the outer surface 102*a* of the tiled finishing layer of the wall structure during installation to achieve a sufficient area of adhesive contact between the outer surface 102*a* of the tiled finishing layer and the double-sided tape 34' on the upper lip 22 of the moulding. FIGS. 10 and 11 illustrate how the caulking-free tape-only second embodiment may include the same break line 40 as the first embodiment to enable optional installation of a stem-reduceable moulding in either a gapped or gapless corner joint, but it will be appreciated that the same use of additional tape 34' on the inner face 26 of the upper lip 22 of the cap 20 may be used on a fixed-stem moulding that lacks a break-line 40 on its base stem 12, whether this base stem is a fixed stem of full width for use in gapped corner joints like that of FIG. 2, or a fixed stem of reduced width for use in gapless corner joints like that of FIG. 5.

It will also be appreciated that the described method of selecting between an intact full-width installation of the moulding or a cut or snapped reduced-width installation of the moulding based on a visual assessment of whether a sufficiently sized gap is available in the corner joint can be performed regardless of whether the base-stem includes a pre-defined break line 40 or not, as one could cut off a distal portion 12*b* of a base stem 12 even the base stem lacks visible cut-guiding break line visually marking where to make this cut. However, such an option would be less user friendly, as it would require the installer to make an unguided or self-measured cut to ensure that the base stem is trimmed by an appropriate amount so that it no longer protrudes past the reference plane occupied by the upper tip of the moulding's upper lip, and preferably terminates right at said reference plane. The ideal result of having the upper the broken end of the remaining proximal portion of the base stem residing in the same reference plane at this upper tip of the moulding is optimal to help square the moulding in a proper orientation in its installed position by abutting of both the upper lip and the broken end of the proximal base stem portion against the outer surface of the wall.

On the other hand, it will be appreciated that even if the base stem were trimmed slightly past the reference plane P to the proximal side thereof, this would not necessarily defeat proper placement of the moulding in a useful position placing the upper tip 22*a* of the cap's upper lip 22 against the outer surface 102*a* of the wall's finishing layer with the intact proximal part 34*a* of the base stem tape 32 adhered flush atop the tub surface 100*a*. Accordingly, while the preferred embodiment places the break line 40 at the reference plane P that intersects the upper tip 22*a* of the cap 20, other embodiments may have the break line 40 somewhat offset from the reference plane P to the proximal side thereof. So whether the break line 40 is centered on the reference plane P to create the break directly at the reference plane P, or is offset proximally of the reference plane to create the break on the proximal side of the reference plane, either way, the remaining proximal portion 12*a* of the base stem 12 after detachment of the broken-off distal portion 12*b* will not protrude beyond the reference plane P at which the outer surface 102*a* of the wall's finishing layer is intended to be received in the installed position of the moulding. Accordingly, the necessary positioning of the break-line relative to the reference plane P may be expressed as a requirement that the distance from the proximal end E of the base stem 12 to the break line 40 must not exceed the distance from the proximal end E of the base stem 12 to the reference plane P that perpendicularly intersects the base stem 12 and contains the upper tip 22*a* of the cap's upper lip 22.

While the forgoing embodiments are described in relation to a bathtub and tiled surround walls standing upright therefrom, the corner mouldings of the present invention may be used in any variety of gapped and gapless corner joints where a first structure (e.g. bathtub, shower tray) has a first exposed surface (e.g. generally horizontal upper surface of the rim of the bathtub or shower tray) residing in a first plane that intersects a second plane occupied by an outer surface (e.g. tile surface) of a second structure (e.g. generally vertical upright wall). The selective detachment of the break-off distal portion 12*b* of the base stem of the moulding is not only useful for tiled walls where the finishing layer has sufficient depth (i.e. as determined by the combined tile and mortar thickness) to accommodate insertion of the base stem if a sufficiently tall gap space is available, but is also useful for contexts where a relatively thin finishing layer (e.g. acrylic tub surround) doesn't provide sufficient depth to accommodate the full-width base stem, in which case the distal base stem portion is broken off by cutting or snapping to enable external flush mounting of the reduced moulding entirety outside the wall structure and its acrylic finishing layer in the same manner described above for a tiled wall structure.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A moulding for use at a corner joint between a first structure having an exposed surface lying in a first plane and a second structure having an outer surface lying in a second plane that intersects said first plane, said moulding comprising:

an elongated body having a longitudinal dimension for extending along the corner joint and a cross-sectional shape that is defined in planes perpendicular to said longitudinal dimension and that comprises a base stem for optional insertion into a gap between the first and second structures, if present, and a cap integrally attached to a proximal end of the base stem to lie outside said gap, if present, the cap defining an upper lip for contact against the outer surface of the second structure at a spaced distance from a topside of the base stem and an underside of the base stem being adherable to the exposed surface of the first structure; and a break line running longitudinally of the base stem to denote a boundary between a proximal portion of the base stem situated adjacent the cap, and a distal portion of the base stem that reaches further from the cap and is selectively detachable from the proximal portion by cutting or snapping of the distal portion from the proximal portion along said break line;

herein:

an adhesive is provided on the underside of the base stem, wherein the adhesive occupies both the proximal and distal portions of the base stem, and the break line denotes a cutting guide for trimming the adhesive down to the proximal portion of the base stem after detachment of the distal portion thereof;

the base stem has a width dimension measured in a direction in which said proximal end of the base stem is spaced from an opposing distal end of the base stem that is situated furthest from the cap;

there is a reference plane that lies parallel to the longitudinal dimension and perpendicular to the width dimension, and that cuts through the base stem and intersects an upper tip of the upper lip of the cap of the body; and measured in the same direction as the width dimension, a distance from the proximal end of the base stem to a center of the break line is no greater than a distance from the proximal end of the base stem to the reference plane, whereby in the presence of said gap between the first and second structures the distal portion of the base stem is insertable into said gap, and in the absence of said gap, the distal portion of the base stem is detachable from the proximal portion along the break line to reduce the base stem to a smaller size capable of fitting between the cap and the outer surface of the inner structure when the upper lip is placed thereagainst.

2. The moulding of claim 1, wherein the adhesive comprises a double-sided tape extending the longitudinal dimension of the body with an upper surface of the tape adhered to the underside of the base stem for adhesion of the underside of the base stem to the exposed surface of the first structure, wherein the double-sided tape occupies both the proximal and distal portions of the base stem, and the break line denotes a cutting guide for trimming the double-sided tape down to the proximal portion of the base stem after detachment of the distal portion thereof.

3. The moulding of claim 1 comprising a length of double-sided tape extending the longitudinal dimension of the body and attached to an inner face of the upper lip below the upper tip thereof for adhesion of said upper lip of the cap to the outer surface of the second structure via said length of double-sided tape.

4. The moulding of claim 1 wherein the break line comprises a weakened snap line of reduced thickness relative to a remainder of the base stem.

5. The moulding of claim 4 wherein the thickness of the break line is sufficient to enable snapped or torn removal of the distal portion of the base stem along the break line.

6. A method of installing moulding at a corner joint between a first structure having an exposed surface lying in a first plane and a second structure having an outer surface lying in a second plane that intersects said first plane, said method comprising:

(a) obtaining a moulding comprising an elongated body having a longitudinal dimension for extending along the corner joint and a cross-sectional shape that is defined in planes perpendicular to said longitudinal dimension and that comprises a base stem for optional insertion into a gap between the first and second structures, if present, and a cap integrally attached to an end of the base stem to lie outside said gap, if present, the cap defining an upper lip for contact against the outer surface of the second structure at a spaced distance from a topside of the base stem and an underside of the base stem being adherable to the exposed surface of the first structure;

wherein:

the base stem has a width dimension measured in a direction in which said proximal end of the base stem is spaced from an opposing distal end of the base stem that is situated furthest from the cap; and there is a reference plane that lies parallel to the longitudinal dimension and perpendicular to the width dimension, and that cuts through the base stem and intersects an upper tip of the upper lip of the cap of the body;

(b) making an assessment of whether there is a sufficiently sized gap that (i) is open between the exposed surface of the first structure and the said outer surface of the second structure, and (ii) has thickness and depth measurements that would accommodate insertion of the base stem into said sufficiently sized gap far enough to place the upper lip of the cap against the outer surface of the second structure; and (c) from said assessment, concluding an absence of said sufficiently sized gap;

(d) based on said concluded absence of said sufficiently sized gap, detaching a distal portion of the base stem from a proximal portion thereof that joins with the cap, thereby shortening a distance by which said base stem projects from the cap, and placing the upper lip of the cap against the outer surface of the second structure and the underside of the remaining proximal portion of the base stem into adhesive attachment to the exposed surface of the first structure;

wherein detachment of the distal portion in step (d) comprises detaching said distal portion from the proximal portion at a distance from the proximal end of the base stem that, measured in the same direction as the width dimension, is no further from said proximal end than said reference plane.

7. The method of claim 6 wherein step (d) comprises snapping the distal portion of the base stem from the proximal portion thereof.

8. The method of claim 6 wherein step (d) comprises tearing the distal portion of the base stem from the proximal portion thereof.

9. The method of claim 6 wherein step (d) comprises cutting the distal portion of the base stem from the proximal portion thereof.

10. The method of claim 6 wherein the moulding has pre-attached double-sided tape adhered to an underside of the base stem at both the proximal and distal portions thereof, and step (d) comprises first detaching the distal portion of the base stem from the proximal portion thereof, and then trimming the double-sided tape down to the remaining proximal portion of the base stem by cutting the double-sided tape along the break line.

11. The method of claim 6 comprising adhesively attaching the upper lip of the cap to the outer surface of the second structure using double-sided tape adhered to an inner face of the upper lip of the cap below an upper tip thereof.

* * * * *